US009500054B2

(12) United States Patent
Miller

(10) Patent No.: US 9,500,054 B2
(45) Date of Patent: Nov. 22, 2016

(54) WELL MULTIPLE CASING INSTALLATION SYSTEM

(71) Applicant: David M. Miller, Bakersfield, CA (US)

(72) Inventor: David M. Miller, Bakersfield, CA (US)

(73) Assignee: David M. Miller, Bakersfield, CA (US)

( * ) Notice: Subject to any disclaimer, the term of this patent is extended or adjusted under 35 U.S.C. 154(b) by 368 days.

(21) Appl. No.: 13/987,729

(22) Filed: Aug. 26, 2013

(65) Prior Publication Data

US 2014/0020889 A1 Jan. 23, 2014

Related U.S. Application Data

(63) Continuation-in-part of application No. 12/927,572, filed on Nov. 17, 2010, now Pat. No. 8,522,884.

(51) Int. Cl.
*E21B 23/00* (2006.01)
*E21B 33/04* (2006.01)

(52) U.S. Cl.
CPC ..... *E21B 23/00* (2013.01); *E21B 33/04* (2013.01)

(58) Field of Classification Search
CPC ..... E21B 23/00; E21B 23/02; E21B 33/047
See application file for complete search history.

(56) References Cited

U.S. PATENT DOCUMENTS

| | | | | |
|---|---|---|---|---|
| 3,329,448 | A | 7/1967 | Allen | |
| 4,311,194 | A | 1/1982 | White | |
| 4,494,778 | A | 1/1985 | Johnson | |
| 4,580,788 | A * | 4/1986 | Rabe | F16L 7/02 277/314 |
| 4,653,589 | A * | 3/1987 | Alandy | E21B 33/043 166/208 |
| 4,886,121 | A | 12/1989 | Demny et al. | |
| 4,928,769 | A | 5/1990 | Milberger et al. | |
| 5,176,218 | A | 1/1993 | Singer et al. | |
| 6,019,175 | A | 2/2000 | Haynes | |
| 6,662,868 | B1 * | 12/2003 | Van Bilderbeek | E21B 33/038 166/88.2 |
| 2005/0194555 | A1 * | 9/2005 | Hall | F16L 13/14 251/146 |
| 2012/0312529 | A1 * | 12/2012 | Ringgenberg | E21B 41/00 166/250.01 |

* cited by examiner

*Primary Examiner* — William P Neuder
(74) *Attorney, Agent, or Firm* — William W. Haefliger

(57) ABSTRACT

Apparatus facilitating successive installation of casing sections endwise in a well, that includes hanger structure sized for installation at a well head, the hanger structure having a vertical through opening via which successive casing sections are installable vertically in the well, the hanger structure having vertically spaced shoulders for landing casing sections, there being adjustable structure for enabling controllable adjustment of hanger length, whereby uncemented casing weight is applied on the hanger structure.

36 Claims, 5 Drawing Sheets

WELL MULTIPLE CASING INSTALLATION SYSTEM

This application is a continuation-in-part of pending U.S. application Ser. No. 12/927,572, filed Nov. 17, 2010, which claims priority from provisional application Ser. No. 61/262,912, filed Nov. 19, 2009, all of which are incorporated herein by reference.

This application also claims the benefit of priority U.S. Provisional Patent Application No. 61/708,867, filed Oct. 2, 2012, entitled "Well Casing Landing System.

BACKGROUND OF THE INVENTION

This invention relates generally to methods and apparatus utilized in the completion of hydrocarbon wells, and is particularly directed to methods for reducing the amount of drilling time and associated expense associated with hanging casing or tubing within a previously installed concentric outer casing.

There is need for improvements in apparatus and method for installing casing strings in oil and gas wells, and which reduce time and cost of such installation.

SUMMARY OF THE INVENTION

It is a major object of the invention to provide method and apparatus to meet needs associated with the above described operations. Basically, the improved method of installing a plurality of casing sections in a well, includes the steps:

a) providing hanger structure sized for installation at a well head, the hanger structure having a vertical through opening via which successive casing sections are installable vertically in the well, b) the hanger structure having vertically spaced shoulders for landing such casing sections, c) providing adjustable means for enabling controllable adjustment of hanger length, whereby uncemented casing weight is applied to the hanger structure.

As will be seen, such adjustable means typically includes wedge surfaces that induce lateral expansion of a lower portion of the hanger structure in response to adjustment of said means. Also, such shoulders are defined by annularly extending supports which are removable from said hanger structure, and adapted to pass casing sections. The annular supports, such as bowls, typically form progressively smaller inner diameters, to facilitate installation and landing of coaxial casing sections.

Another object is to provide body sections that are laterally removably away from landed casing. As will be seen, at least one body section includes detachable components removable laterally away from installed casing, at the well head. Bowl sections and their supports are also laterally removable.

A further object is to provide for enhanced O-ring sealing against well casing, as in installations described herein.

The basic method of installing well head production apparatus onto well casing successively connected into position in a well, includes:

a) installing and landing multiple concentric casing strings in the well, for cementing, b) detecting unwanted weight induced downward displacement of a selected string or strings after attempted string cementing, and while landing weight is temporarily relieved and until no such downward displacement of a last installed casing string is detected, d) and then connecting said production apparatus to upper extent of the last installed casing string.

As will be seen, at least one body section is sidewardly laterally removable away from the landed head of casing that has been successfully cemented, to allow connection to that head of well producing apparatus.

These and other objects and advantages of the invention, as well as the details of an illustrative embodiment, will be more fully understood from the following specification and drawings, in which:

DRAWING DESCRIPTION

DETAILED DESCRIPTION

Figure 1:
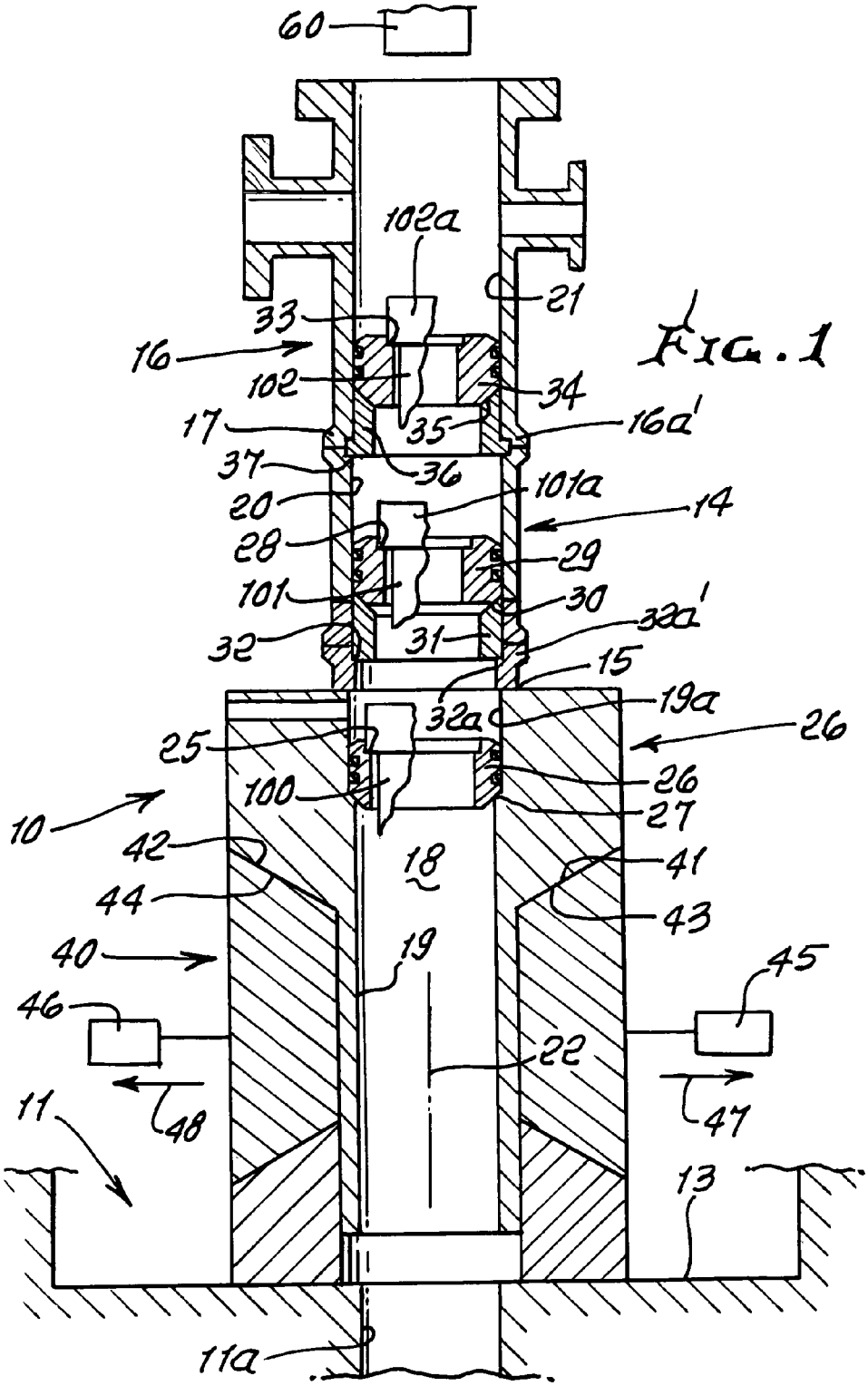
FIG. 1 is a vertical section taken through assembled structure embodying the invention.
Figure 2:
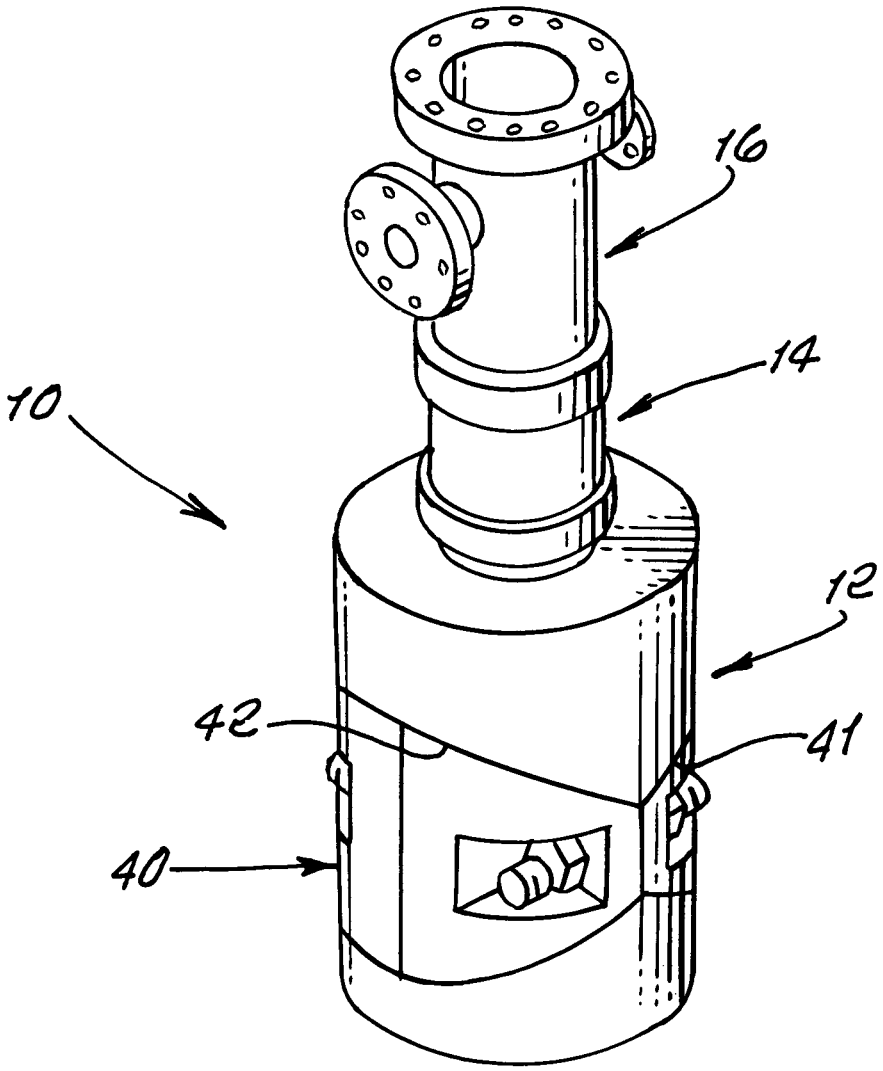
FIG. 2 is a perspective view of the FIG. 1 structure.
Figure 4:
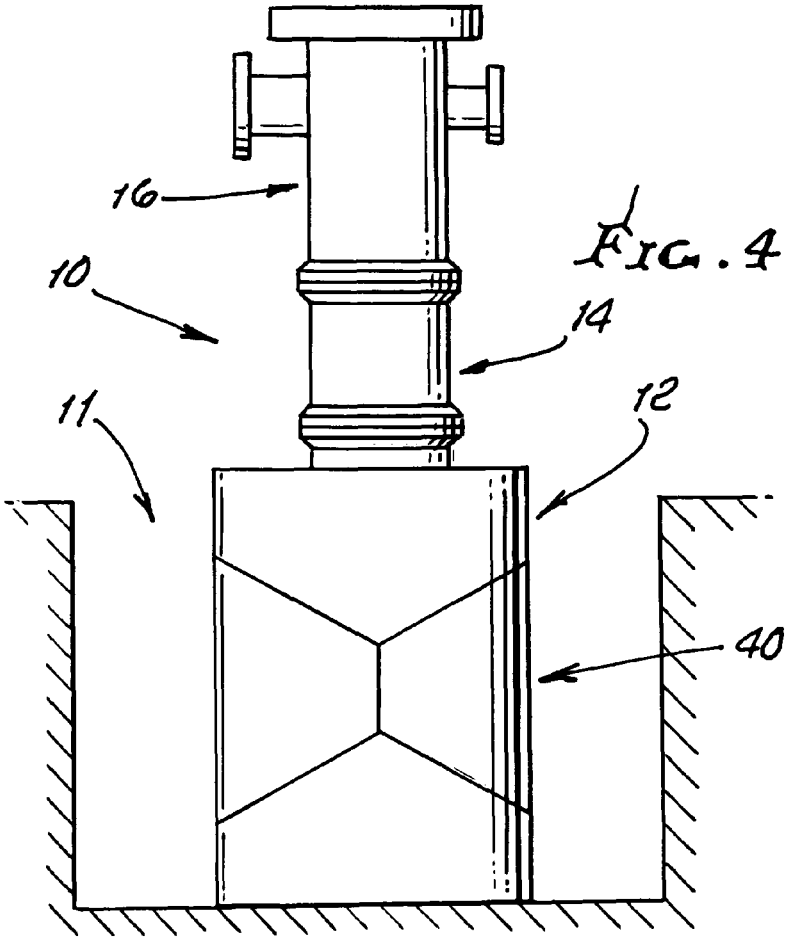

Referring first to FIG. 1, and to the FIG. 4 schematic, it shows apparatus 10 to be installed at a well site 11 to facilitate successive installation of casing string sections in the well. Such apparatus includes a lower body section 12 be installed as at surface 13, an upper body section 14 carried at 15 by section 12, and a yet further upper body section 16 carried at 17 by section 14. All such sections may be considered as casing hanger structure sections.

The sections define a vertical through opening 18, as at bores 19 and 19*a* in section 12; bore 20 in section 14 and bore 21 in section 16, all such bores being co-axial, i.e. with respect to common axis 22. Through opening 18 is adapted to pass casing installable vertically in the well 11*a*.

The hanger structure has or includes vertically spaced shoulders for landing different casing sections. For example, annular shoulder 25 to support casing 100 is defined by first annulus or bowl 26 supported at annular shoulder 27 in lower body section 12, second annular shoulder 28 to support casing 101 is defined by second annulus or bowl 29 supported at tapered annular shoulder 30 on annulus 31, which is in turn supported at 32 to structure 32*a* associated with body section 14; and third annular shoulder 33 to support casing 102 defined by third annulus or bowl 34 supported at tapered annular shoulder 35 on annulus 36, which in turn supported at 37 by the second or upper body section 14.

Annulus 31 interfits body structure 32*a* and 14, and annulus 26 interfits body structure 16*a* and 16 aiding stabilization of the assembled body section.

In this regard, the second bowl 29 and its support 31 are downwardly installed in the bore via hanger body sections 16 and 14 after casing 100 is installed downwardly; and the third bowl 34 and annular 36 are installed after casing 101 is installed downwardly into landed position.

Adjustable means is provided for enabling controllable adjustment of hanger length, whereby uncemented casing weight is applied on the hanger structure.

As shown in FIG. 1, the adjustable means 40 includes interengaged wedge surfaces 41 and 42 engaging wedge surfaces 43 an 44 on body 12, and schematically shown actuators 45 and 46 operable to move surfaces 41 and 42 in opposite directions 47 and 48 away from the shoulders 43 and 44 of section 12. If section 12 then drops, along with sections 14 and 16, it indicates that cementing of casing 100 supported at 27 is not completed.

A second string of casing 101 is then run into the well, and through casing 100, and landed at 28. Cementing is then continued through the two casings. when cementing is completed, the wedge surfaces 41 and 42 are moved further away from surfaces 43 and 44. If the casing drops 100, along with casing 101 and body sections 12, 14 and 16 it means that such second attempted cementing is not completed or effective. A third string of casing 102 is then run into the well, and through both casings 100 and 101. Cementing is then continued through the three casings, until successful. Well producing apparatus is then connected onto the projecting head 102*a* of the successively cemented casing 102 after body sections 14 and 16 are removed, laterally, to expose casing head 102*a*. If casing 101 had been successfully cemented, the wall producing apparatus could be connected to head 101*a*.

Figure 3:
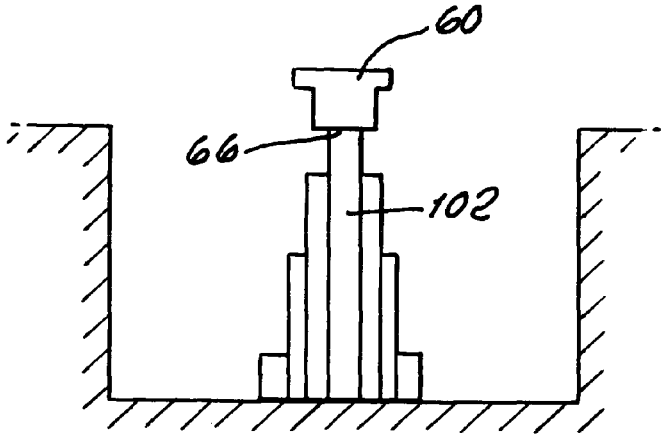
FIGS. 3 and 4 are schematic views of completed installation.
Figure 6:
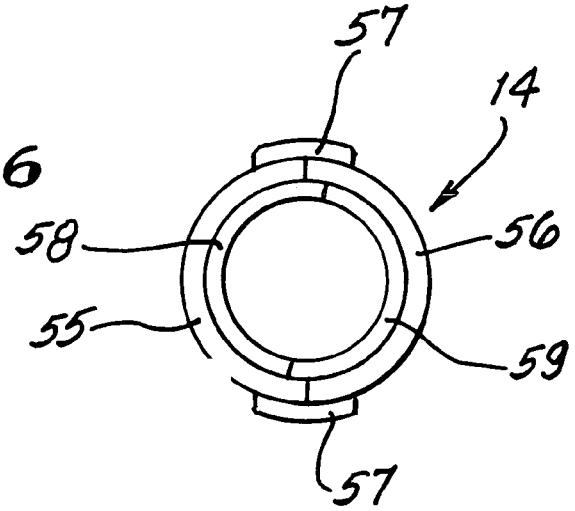
FIG. 6 shows body section removability.

After the casing string or strings have been run into position, and the last string successfully cemented, the upper body sections 14 and 16 are removed, laterally away from the casing. To enable this, sections 14 and 16 may be split to each include detachable components 55 and 56, as shown in FIG. 6, connected as by latches 57, or by flange connections on the body sections, facilitating lateral removal of such components as well as sections 58 and 59 of the bowls and of bowl support sections respectively shown at 31 and 36. The latter may also include sections removable laterally away from the casing, with the components 55 and 56. This enables rapid access of well production equipment 60 to the casing head or heads seen in FIG. 3, and particularly to the casing that produces well fluid (oil, gas, etc.) See FIG. 3 installation, with production connection 66 welded in position after removal of body sections 14 and 16.

Accordingly, the method of installing well head production apparatus onto well casing successively connected into position in a well, basically includes:

a) installing and landing multiple concentric casing strings in the well, for cementing, b) detecting unwanted weight induced downward displacement of at least one and preferably multiple casing strings after attempted string cementing, and while such landing is temporarily relieved, and until no such downward displacement of a last installed casing string is detected, c) and then connecting said production apparatus to upper extent of said last installed casing string.

As will be seen, step b) typically comprises detecting unwanted weight induced downward displacement of multiple of the casing strings after attempted string cementing. Such multiple strings typically include three strings installed before cementing.

Also, latches may be provided to hold the body sections in position to support the bowls. The body sections are outwardly removable to facility attachment of well production equipment to the last installed casing string. Body section flanges may be used instead of latches and may be disconnected to enable section removal. See flanges 16*a* and 16*a*', and 32*a* and 32*a*'.

Figure 5:
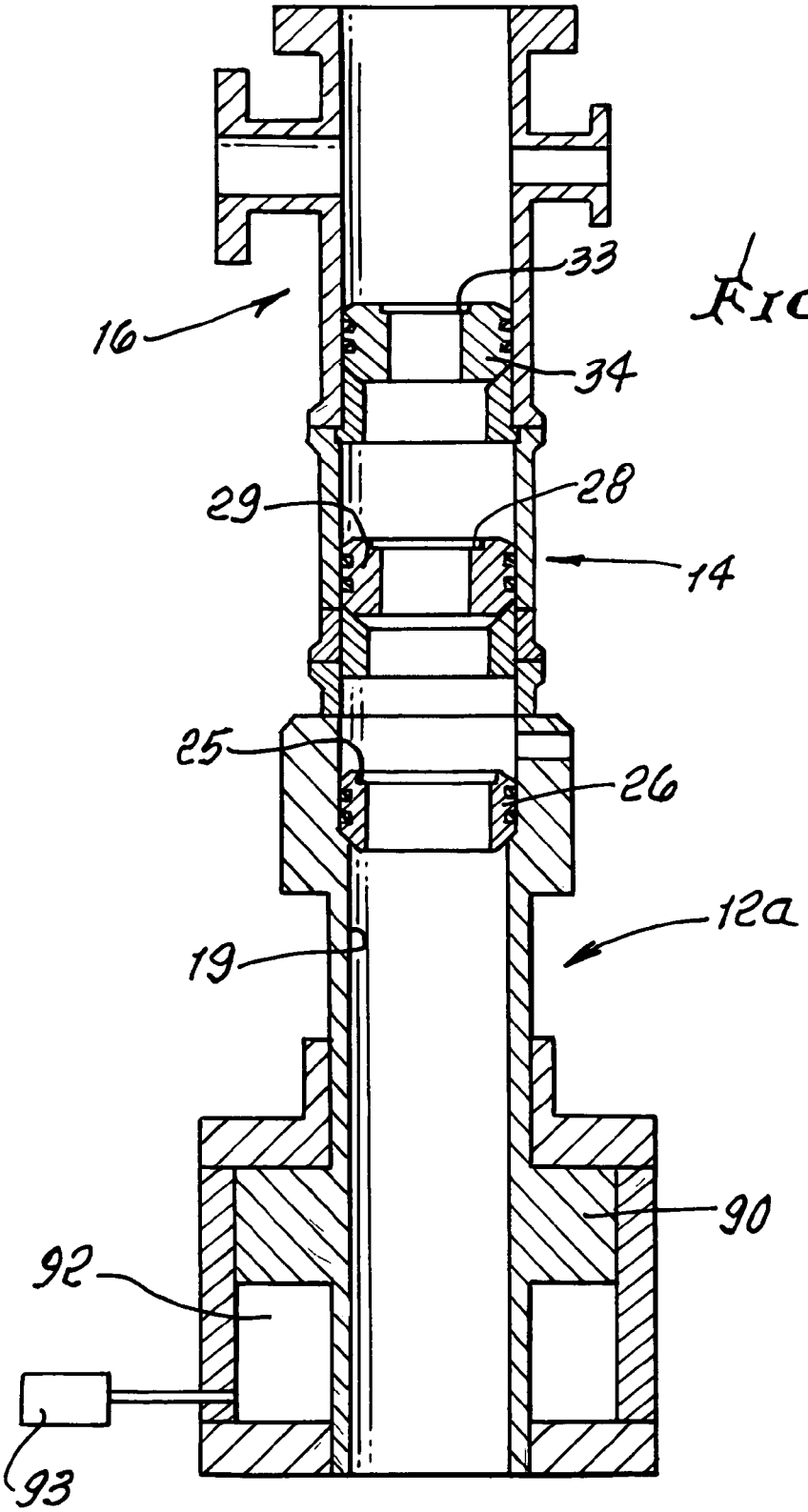
FIG. 5 shows a modification.

In the modification shown in FIG. 5, the modified lower body section 12*a* has a lower extension 90 in the form of a piston, movable downwardly in cylinder 19 of uncemented casing weight is applied to bowl 26. Resistance to piston downward travel, as by fluid pressure at 92 in the cylinder, is controlled as at 93.

Figure 7:
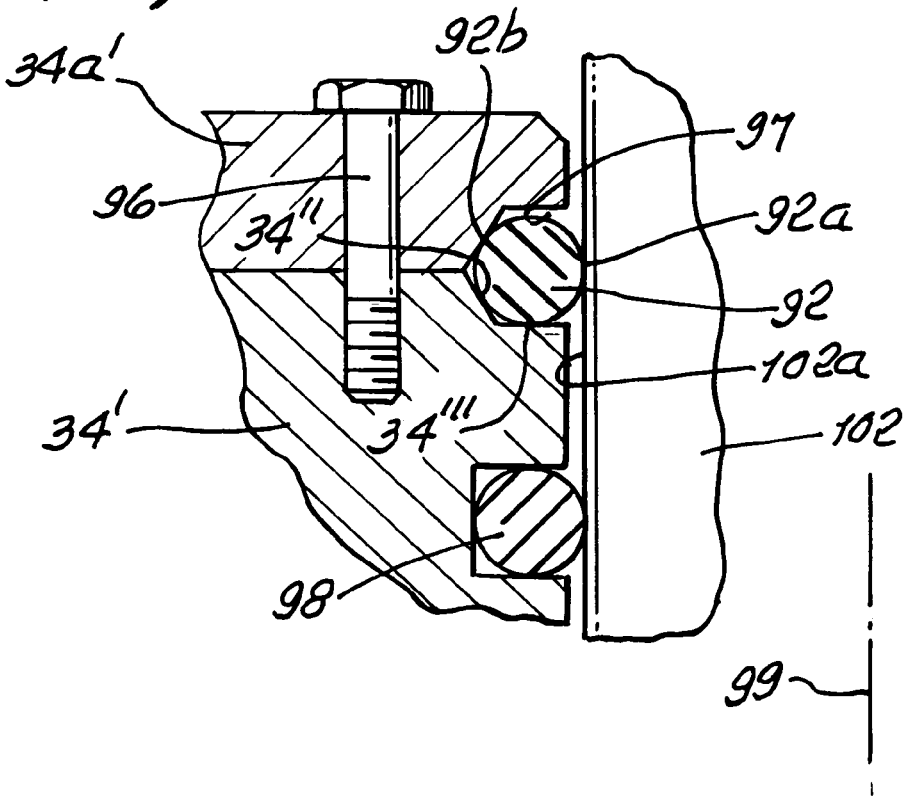
FIG. 7 shows modified O-ring sealing.

FIG. 7 shows a modified bowl such as bowl 34' incorporating annular sealing structure for sealing off against the surface of casing, such as casing surface 102*a*. Such structure includes an elastomeric O-ring 92 extending about the casing and sealing at 92*a* against the casing surface.

The sealing structure also includes O-ring annular retention surfaces 34" and 34'" formed by bowl 34' serving to pressurize and seal against the O-ring for enhancing its sealing at 92*a* against the casing surface 102*a*.

A holder in the form of extension 34*a*' of 34' overlies 34' and is adjustably bolted at 96 to 34'. That extension adjustably downwardly pressurizes and seals against the upper angular side, at 92*b* of the O-ring, additionally enhancing effective and adjustable sealing against the casing at 92*a*, as referred to. Also, space 97 is created above the O-ring to allow pressure to deform the O-ring, pushing it down in space 97 as well. The angular surface at 34" also acts similarly. The pressurizing surface angles at 92*b* and 34" typically are between 35° and 55° in planes containing the O-ring axis 99.

Accordingly, an O-ring with multiple annular sealing surfaces is provided, corresponding to the pressurizing annular surfaces. A second O-ring 98 is spaced co-axially from O-ring 92. See O-ring axis 99.

As will be seen, the method of pressurizing the O-ring to provide enhanced sealing against the work surface of the casing, includes the following steps, in relation to the O-ring axis a) providing multiple spaced apart pressurizing and relatively angled surfaces that extend annularly about the O-ring axis, and about the work, b) and relatively displacing at least two of said surfaces spaced apart lengthwise of said axis to annularly engage the O-ring at different angles, thereby deforming the O-ring as it seals against the work.

The method enables provision of space adjacent at least one of such surfaces to receive O-ring deformation adjacent the work. The O-ring is resiliently deformable, for example elastomeric.

I claim:

1. Apparatus facilitating successive installation of casing sections endwise in a well, that includes:

a) hanger structure sized for installation at a well head, the hanger structure having a vertical through opening via which successive casing sections are installable vertically in the well, b) the hanger structure having vertically spaced shoulders defined by removable supports for landing casing sections, c) there being adjustable means for enabling controllable adjustment of hanger length, whereby uncemented casing weight is applied on the hanger structure.

2. The apparatus of claim 1 wherein said adjustable means includes interengaged wedge surfaces that induce lateral expansion of a lower portion of the hanger structure in response to adjustment of said adjustable means.

3. Apparatus facilitating successive installation of casing sections endwise in a well, that includes:

a) hanger structure sized for installation at a well head, the hanger structure having a vertical through opening via which successive casing sections are installable vertically in the well, b) the hanger structure having vertically spaced shoulders defined by removable supports for landing casing sections, c) there being adjustable means for enabling controllable adjustment of hanger length, whereby uncemented casing weight is applied on the hanger structure, d) and wherein said shoulders are defined by annular supports which are removable from said hanger structure, and adapted to pass said casing sections.

4. The apparatus of claim 3 wherein in an upward direction said annular supports have progressively smaller inner diameters.

5. The apparatus of claim 3 including annular sealing structure associated with at least one annular support for sealing off against well casing.

6. The apparatus of claim 5 wherein said sealing structure includes an O-ring and at least two spaced annular sealing surfaces against which the O-ring seals in addition to sealing off against well casing.

7. The apparatus of claim 6 wherein at least one of said annular sealing surfaces extends at on angle between about 35° and 55° in planes containing the O-ring axis.

8. The apparatus of claim 7 wherein there are multiple of said sealing structure spaced lengthwise of the casing.

9. The apparatus of claim 6 including a holder spaced from said two surfaces pressurizing the O-ring to seal off against the casing section and also to seal against said sealing services.

10. The apparatus of claim 6 wherein the sealing structure includes a second O-ring located coaxially with the first mentioned O-ring.

11. Apparatus facilitating successive installation of casing sections endwise in a well, that includes:

a) hanger structure sized for installation at a well head, the hanger structure having a vertical through opening via which successive casing sections are installable vertically in the well, b) the hanger structure having vertically spaced shoulders defined by removable supports for landing casing sections, c) there being adjustable means for enabling controllable adjustment of hanger length, whereby uncemented casing weight is applied on the hanger structure, d) and wherein said hanger structure includes body sections providing a vertical opening to receive the casing strings landed at vertically spaced locations.

12. The apparatus of claim 11 wherein said hanger structure is defined by bowls located at vertically spaced locations in the body sections.

13. The apparatus of claim 12 wherein said casing includes a head adapted to be landed, at least one body section being configured to be sidewardly laterally removable away from the landed head of casing that has been successfully cemented, to allow connection of well producing apparatus to said head.

14. The apparatus of claim 12 including supports in said body section supporting said bowls.

15. The apparatus of claim 12 wherein said bowls have upwardly successively reduced diameters.

16. The apparatus of claim 12 wherein at least one of said body sections is laterally removable away from casing landed at a bowl therein.

17. The combination of claim 12 wherein at least one body section includes detachable components removable laterally away from installed casing, at the well head.

18. The combination of claim 17 including means holding the body section components in detachable assembled condition.

19. The combination of claim 17 including supports in said body sections supporting said bowls, at least one support including detachable components removable laterally away from installed casing, at the well head.

20. The combination of claim 19 wherein the supports have relatively removable sections.

21. The combination of claim 18 wherein the bowl sections are held in assembled annular condition by the latch means.

22. The combination of claim 21 including supports in said body sections supporting said bowls, at least one support including detachable components removable laterally away from installed casing, at the well head.

23. The combination of claim 22 wherein the support sections are also held in assembled annular condition.

24. The combination of claim 12 including a well head, and wherein at least one body section includes detachable components removable laterally away from installed casing, at the well head, and together with said bowl or bowls.

25. The combination of claim 24 wherein the bowls having relatively removable sections.

26. The method of installing well head production apparatus onto well casing connected into position in a well, that includes:

a) installing and landing multiple concentric casing strings in the well, for cementing, b) detecting unwanted weight induced downward displacement of at least one selected string after attempted string cementing, and while landing weight is temporarily relieved, and until no such downward displacement of a last installed casing string is detected, c) and then connecting said production apparatus to an upper, extent of said last installed casing string.

27. The method of claim 26 wherein body sections are provided to define a vertical opening to receive the casing strings landed at vertically spaced locations.

28. The method of claim 27 wherein casing landing bowls are provided at vertically spaced locations in the body sections.

29. The method of claim 28 wherein at least one body section is sidewardly laterally removable away from casing that has been successfully cemented, to allow connection to said head of well producing apparatus.

30. The method of claim 29 includes providing removable latches to hold body sections in position to support said bowls.

31. The method of claim 29 including providing detachable and removable flanges on the body sections to hold the body sections in position to support said bowls.

32. The method of claim 26 wherein said detecting is effected by moving a piston and cylinder assembly wherein casing weight is applied to the piston, and resisted by fluid in the cylinder.

33. The method of claim 26 herein said step b) comprises detecting unwanted weight induced downward displacement of multiple of the casing strings after attempted string cementing.

34. The method of claim 33 wherein said multiple casing strings include three of said strings, which are installed before said cementing.

35. The method of claim 26 wherein an O-ring is provided and pressurized to provide enhanced sealing against a work surface, of said apparatus, the O-ring having an upright central axis, that includes the following steps:

a) providing multiple spaced apart pressurizing and relatively angled surfaces that extend annularly about the O-ring axis, and about the work, b) and relatively displacing at least two of said surfaces spaced apart lengthwise of said axis to annularly engage the O-ring at different angles, thereby deforming the O-ring as the O-ring seals against the work, c) one of said surfaces extending upwardly and angled laterally away from said axis, a second of said surfaces extending upwardly and angled laterally toward said axis.

36. The method of claim 35 including simultaneously providing space adjacent at least one of said work surfaces to receive O-ring deformation.

* * * * *